US005746150A

United States Patent [19]

Beaulac et al.

[11] Patent Number: 5,746,150

[45] Date of Patent: May 5, 1998

[54] BOAT FOR USE WITH A PERSONAL WATERCRAFT

[76] Inventors: Daniel E. Beaulac, RR5, S.22, B26, Prince Albert, Saskatchewan, Canada, S6V 5R3; Trevor S. Hewison, 2980B - 5th Ave East, Prince Albert, Saskatchewan, Canada; Wayne Washington, 1213 River St. E., Prince Albert, Saskatchewan, Canada, S6V 0B7

[21] Appl. No.: 389,882

[22] Filed: Feb. 17, 1995

[51] Int. Cl.[6] ..... B63B 21/54

[52] U.S. Cl. ..... 114/248; 114/77 R; 114/352

[58] Field of Search ..... 114/248, 352, 114/77 R, 259, 263, 270

[56] References Cited

U.S. PATENT DOCUMENTS

| | | | |
|---|---|---|---|
| 3,486,476 | 12/1969 | Breit, Jr. | 114/248 |
| 3,659,546 | 5/1972 | Miklos . | |
| 4,909,176 | 3/1990 | Kobayashi . | |
| 5,145,426 | 9/1992 | Kobayashi et al. . | |
| 5,151,057 | 9/1992 | Kobayashi et al. . | |
| 5,184,564 | 2/1993 | Robbins et al. . | |
| 5,255,625 | 10/1993 | Hattori | 114/270 |
| 5,353,730 | 10/1994 | Talbot | 114/248 |

FOREIGN PATENT DOCUMENTS

| | | |
|---|---|---|
| 465 996 A2 | 1/1992 | European Pat. Off. . |
| 4-63788 | 2/1992 | Japan . |
| 4-71985 | 3/1992 | Japan . |

*Primary Examiner*—Sherman Basinger

[57] ABSTRACT

An improved small boat that allows various brands of narrow motorboats or jet propelled personal watercraft to enter a docking bay between twin rear hulls and be secured in the docking bay. The boat of this present invention is an open hull, fiberglass reinforced plastic unit with high, protective walls and comfortable seats to provide an enjoyable ride for passengers, and storage for their possessions. A U-shaped channel receives the bumper of a personal watercraft. A boomerang shaped ride plate assists in eliminating turbulence in the docking bay that might slow the boat down.

4 Claims, 7 Drawing Sheets

BOAT FOR USE WITH A PERSONAL WATERCRAFT

FIELD OF THE INVENTION

This invention relates to boats and in particular to boats intended for use with personal watercraft.

BACKGROUND OF THE INVENTION

The design of boats for various purposes is an old and well applied art. The recent growth in the number of jet powered personal watercraft (PWC) have created a demand for increased safety and comfort for passengers. A PWC has a small sealed hull with an internal combustion engine and jet pump that normally only carries one person. At times it is desirous to carry extra passengers, fuel, baggage, and food to a destination. PWC are seriously limited in this regard.

Another problem is the instability of PWCs because of their narrowness and rounded hull. People riding a PWC are subject to being immersed in water when the unit is stationary or at low speeds. Properly attaching a PWC to another small boat creates a great degree of stability.

Several styles of driven boats are found in previous art that include a U-shaped boat driven by a smaller watercraft or removable propelling device. These include U.S. Pat. Nos. 5,184,564 to Robbins et al and 3,659,546 to Miklos and Japanese application no. 2-175592 of Kobayashi.

Robbins et al disclose an inflatable boat having a U-shaped tube or pontoon which surrounds the PWC. Miklos discloses a solid pontoon boat which provides a space for a PWC. Kobayashi discloses an open hulled boat with a floor plate between two rear hulls that only a few particular makes of PWC can ride on. Operational and safety problems are encountered with all of these methods.

To overcome the limitations encountered by this previous art, extensive research was conducted to develop a new system.

SUMMARY OF THE INVENTION

Accordingly, it is a principal object of the invention to provide a reliable and cost-effective method of moving people and objects in a small boat. It is a further object of the invention to create a safer and more efficient small boat.

According to one aspect of the invention there is provided a boat for use with a personal watercraft, the personal watercraft having a bumper, and the boat having twin rear hulls forming a docking bay for the PWC, also includes U-shaped bumper receiving channels on either side of the docking bay for securing the bumper of the PWC.

The height and pitch of each U-shaped bumper receiving channel is preferably set for each particular PWC.

A rigid transom board may be used to connect the rear of the first and second rear hull portions and a motor may be mounted to the rigid transom board.

BRIEF DESCRIPTION OF THE DRAWINGS

There will now be described preferred embodiments of the invention, with reference to the drawings, by way of illustration, in which like numerals denote like elements and in which.

DETAILED DESCRIPTION OF PREFERRED EMBODIMENTS

Figure 1:
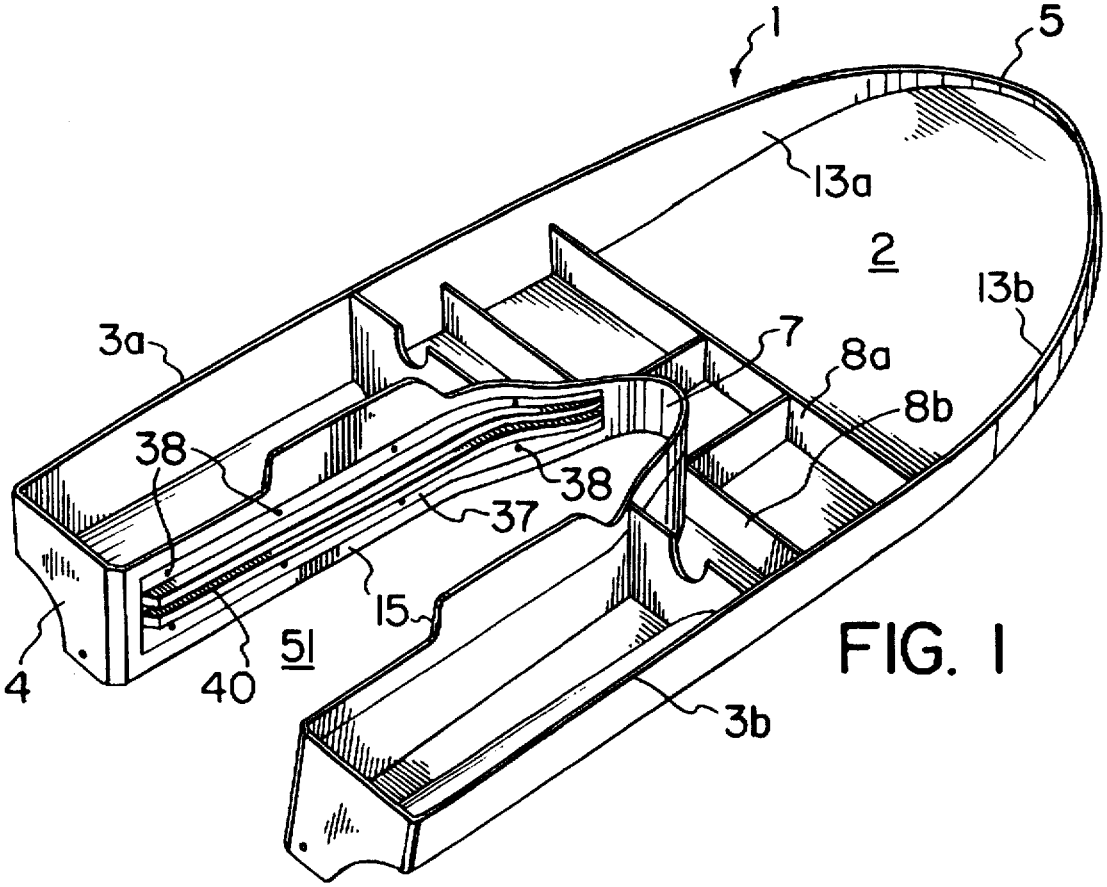
FIG. 1 is a perspective view of a hull with PWC mounting mechanism made in accordance with the present invention.
Figure 2:
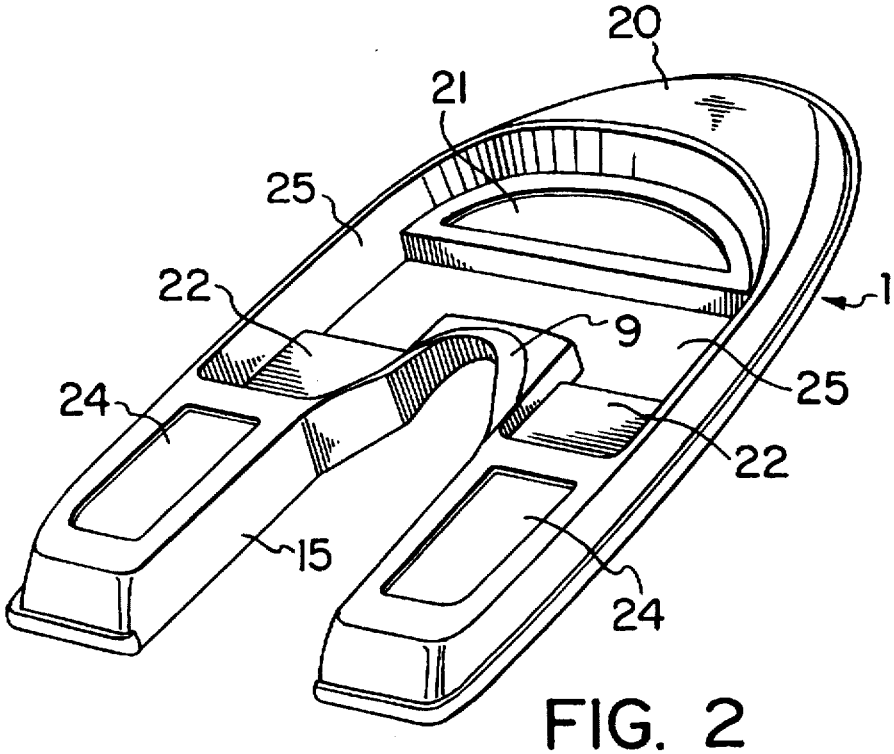
FIG. 2 is a perspective view of a deck made in accordance with the present invention.
Figure 3:
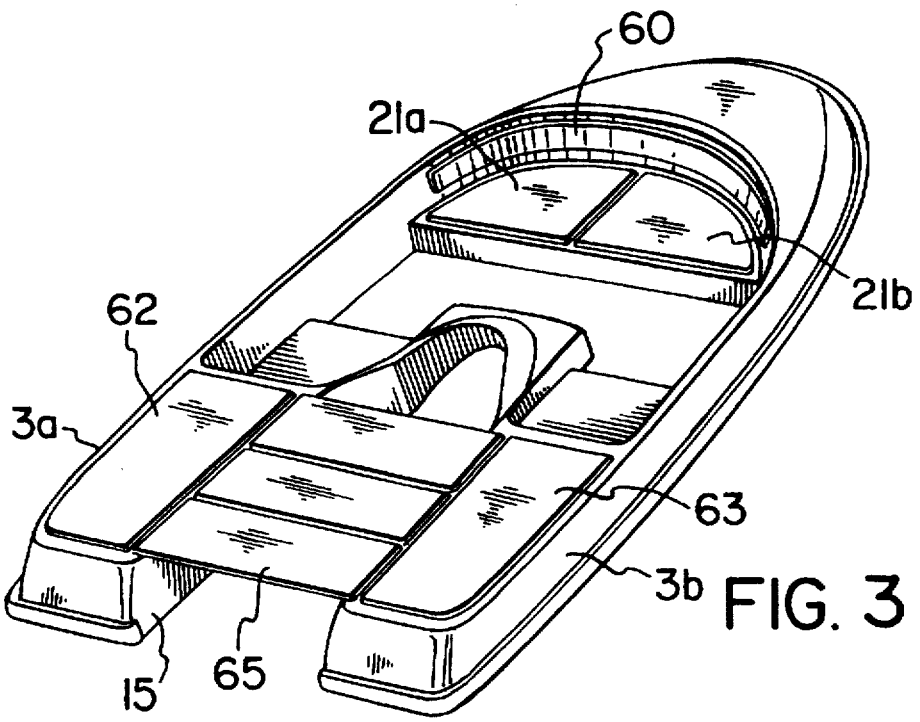
FIG. 3 is a perspective view of a sundeck configuration for the boat of the present invention.

Referring now to FIG. 1, FIG. 2 and FIG. 3 in particular, there is shown a boat 1 that includes a bow 5 and a stern 4. The stern 4 of the hull 1 is separated into first and second rear hull portions 3*a* and 3*b* forming a docking bay 51 between them. The bow of the boat 1 encloses a front hull portion 2. The docking bay 51 creates an enclosure for a narrow motorboat or specifically a jet powered personal watercraft (PWC).

In a preferred embodiment, the boat hulls 3*a* and 3*b* are formed of fibreglass reinforced plastic. The docking bay 51 terminates towards the bow 5 with a hull wall 7 and PWC nose rest or receptacle 9, that has a concave shape, suitable for receiving the nose of a personal watercraft.

A main transverse rib 8*a*, which may be made of similar materials, traverses the front hull 2 forward of the twin rear hulls 3*a* and 3*b*. Secondary transverse ribs 8*b* extend across the front portions of the twin rear hulls 3*a* and 3*b* and may also be used to give additional strength to the hull. The main rib 8*a* extends across the bow 5 from exterior hull wall 13*a* to exterior hull wall 13*b* adjacent the rear hull portions 3*a* and 3*b*. The main rib 8*a* is situated directly in front of the PWC nose rest 9 and wall 7. The ribs 8*a* and 8*b* strengthen and reduce bending of the twin rear hulls 3*a* and 3*b*. Additional ribs may be provided as desired to strengthen the hull.

Also shown in FIG. 2 and FIG. 3 is an arrangement of a boat 1 showing a deck structure. A front deck 20 across the bow 5 of the boat 1 drops to front seats 21 which span the width of the boat 1. Further seats 22 are located in the hulls 3*a* and 3*b* beside the front portion of the docking bay 51. Floor space 25 is provided in front of seats 22. Storage compartments 24 are located behind the rear seats 22 in the rear hull portions 3*a* and 3*b*.

FIG. 3 shows a boat with a sundeck configuration including bowback 60 at the rear of the front deck 20, upholstered front seats 21*a* and 21*b*, upholstered back left hatch 62 on rear hull 3*a* and upholstered back right hatch 63 on rear hull 3*b*, and reinforced fibreglass panels 65 spanning the docking bay 51. When the PWC has been removed from the docking area, the panels 65 can be set over the docking bay 51 to form a sun deck or provide more useable space. The panels 65 rest on suitable ledges on the sides 15 of the hull portions 3*a* and 3*b* or are provided with downward facing grooves to fit on the sides 15 of the hull portions 3*a* and 3*b*.

Figure 10A:
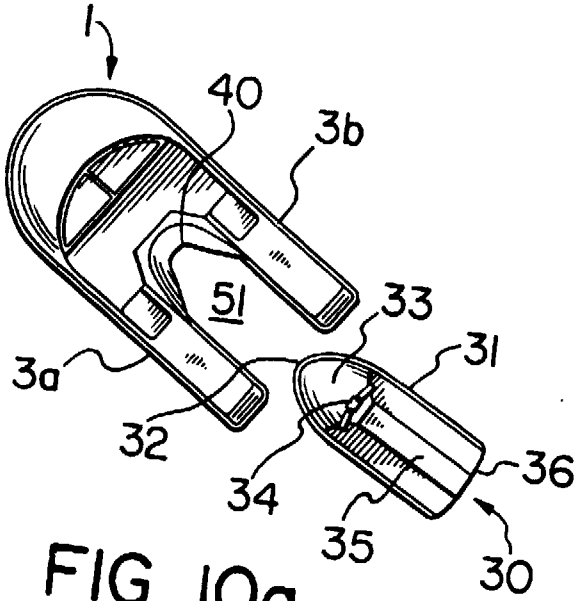
FIGS. 10A, 10B and 10C are top views of a PWC docking in the boat of the invention.
Figure 10B:
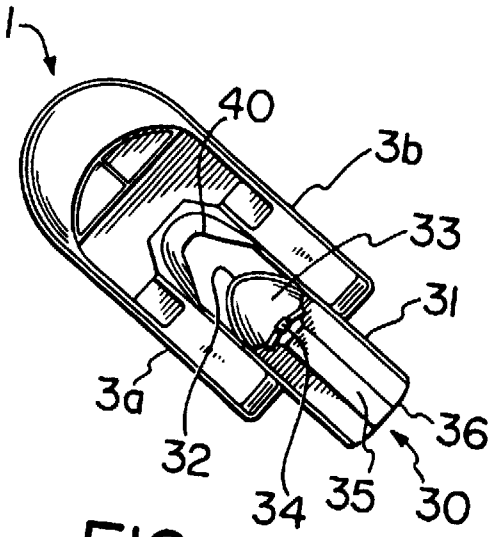
Figure 10C:
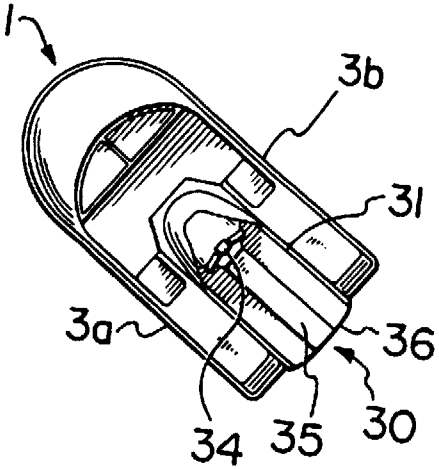

FIGS. 10A, 10B and 10C show a PWC 30 being navigated into the docking bay 51. The PWC 30 includes a nose 32, front deck 33, steering mechanism such as handle bar 34, seat 35, bumpers 31, which extend around both sides and front of the PWC 30 and hull 36 (FIG. 4B).

The combined boat and PWC can be operated from the PWC seat 35 and controlled with the handlebar 34 or optionally can be operated by remote controls within the boat 1 that are connected to the PWC 30.

The PWC 30 may be docked in the boat 1 in the following manner. The PWC 30 is docked by approaching the boat 1 from the rear (FIGS. 10A, 10B) and sliding the side bumpers 31 into U-shaped bumper receiving channels 40 forming a fixed PWC mounting mechanism (one on each side of the docking bay) that may be custom fit for a particular model PWC. In a preferred embodiment, the PWC 30 is secured to the boat 1 by simply driving the PWC into the docking bay 51 where friction between the U-shaped bumper receiving channels 40 and the bumper of the PWC holds the PWC 30 in place. If desired, straps or hooks may be used to hold the boat in place, but these are not necessary.

Figure 4A:
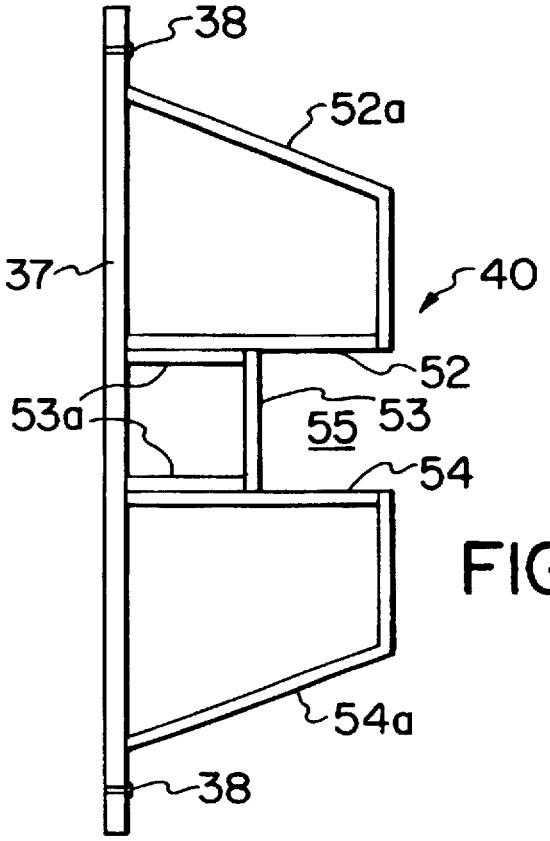
FIG. 4A is a cross section of a first, preferred, U-shaped bumper receiving channel of the present invention.
Figure 4B:
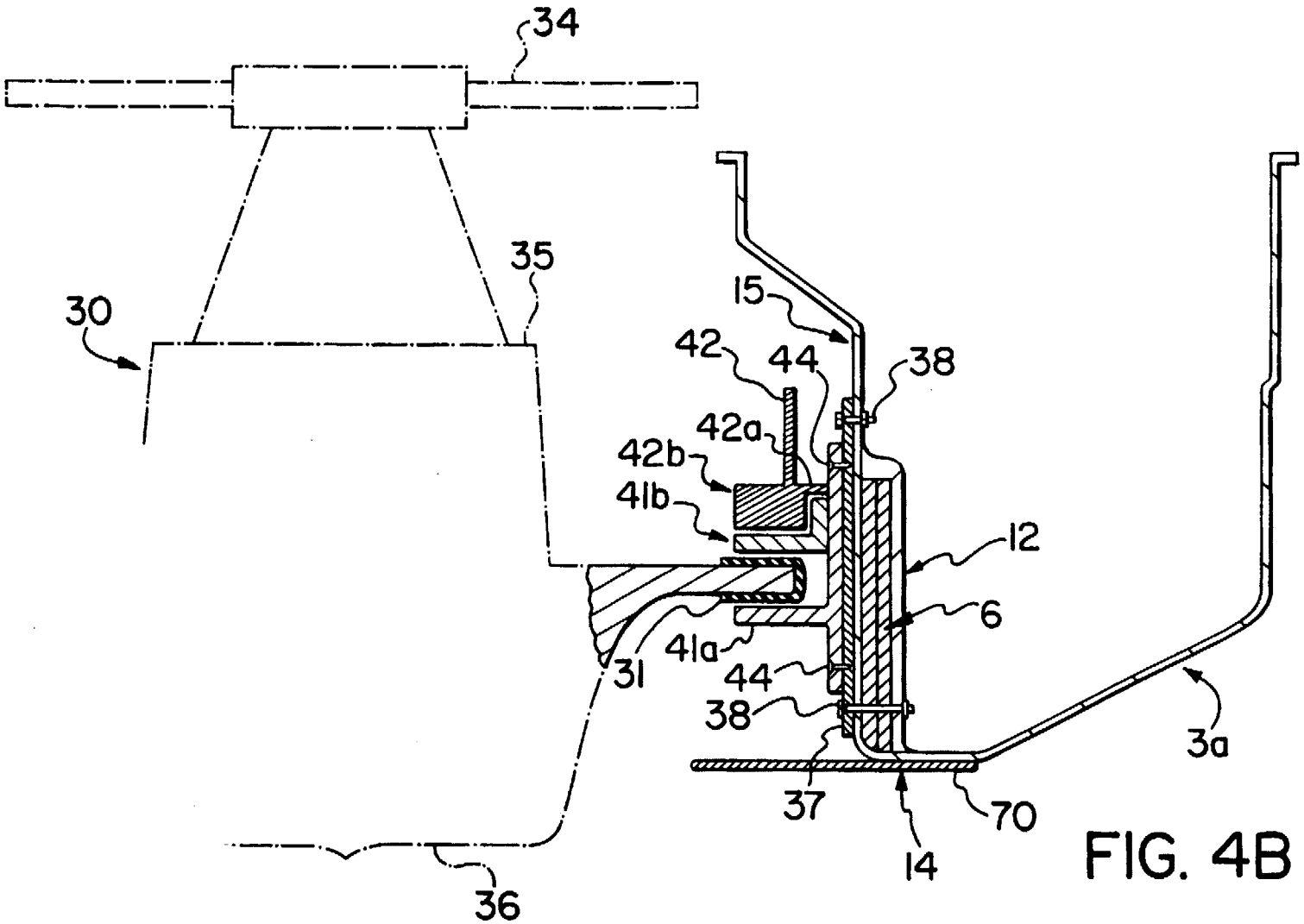
FIG. 4B is a cross section of a second U-shaped bumper receiving channel of the present invention.

Now referring to FIGS. 1, FIG. 4A and 4B in particular, is shown a PWC mounting mechanism. The docking device includes U-shaped bumper receiving channels 40 formed on the sides 15 of each rear hull portion 3*a* and 3*b*. Only one will be described, as the other has the same construction. A flat plate 37 is permanently fastened to the inner wall 15 of the rear hull 3*a* by means of bolts 38. Mounted on the flat plate 37 are three walls 52, 53 and 54 defining a channel between them. The actual design shown in FIG. 4A shows one possible manner of construction, although it is preferred that the walls 52, 53 and 54 be made of solid fibreglass or moulded plastic. Walls 52 and 54 extend out from the plate 37 about at right angles and spaced from each other by a little more than the bumper of a PWC for which the boat is intended. Walls 52 and 54 are supported and strengthened by wall supports 52*a* and 54*a* respectively. Wall 53 extends between walls 52 and 54, set back from the furthest extending parts of walls 52 and 54, and is supported by wall supports 53*a*. The length of the wall supports 53*a*, or equivalently, the separation of the walls 53 on either side of the docking bay 51 is set according to the bumper width of the PWC for which the mounting mechanism is intended. The spacing of the walls 53 across the bay 51 should be slightly greater than the width of the PWC from bumper to bumper so as to allow the PWC to fit in the mounting mechanism, yet to bind against the channel walls if the PWC is not removed rearward in a more or less straight line. In FIG. 4A, the channel 55 has dimensions 42 mm by 42 mm.

An alternative U-shaped bumper receiving channel is shown in FIG. 4B, the channel in this instance being defined by an adjustable plate 41*a*, on which slides a locking plate 41*b*, is then fastened to the permanent flat plate 37 with screws 44. The adjustable plate 41*a* is located at the proper depth (height) and angle (pitch) for the PWC 30 being used to propel the boat 1. The height and pitch of the adjustable plate 41*a* may be adjusted by selection of the location of the screws 44. The pitch is the degree of rotation of the plate about a transverse axis of the boat. A locking (movable) plate 41*b* is provided above the adjustable plate 41*a*, and slides with projections (not shown) on the side of the plate in slots (not shown) in the plate 41*a*. A lever 42 with an eccentric fulcrum 42*b* rotates about an arm 42*a* inserted in the plate 41*a*, and forms a means to move the locking plate 41*b* in relation to the adjustable plate 41*a*. The adjustable plate 41*a*, locking plate 41*b* and moving mechanism together form a U-shaped bumper receiving channel for securing the bumper of the PWC 30.

Also shown in FIG. 4B is an optional reinforcement for the hull portion 3*a* including layers of wood 6 adhered to fibreglass side 12 and bottom 14 of rear hull 3*a*. The rear hull 3*b* may also be constructed in like manner.

To secure the PWC 30, the PWC 30 is first inserted into the docking bay 51 with its bumpers 31 engaged between the locking plate 41*b* and plate 41*a*. The locking plate 41*b* slides down towards the plate 41*a* as the eccentric lever 42 is rotated in one direction. To release the PWC, the lever 42 is turned in the opposite direction.

Figure 5:
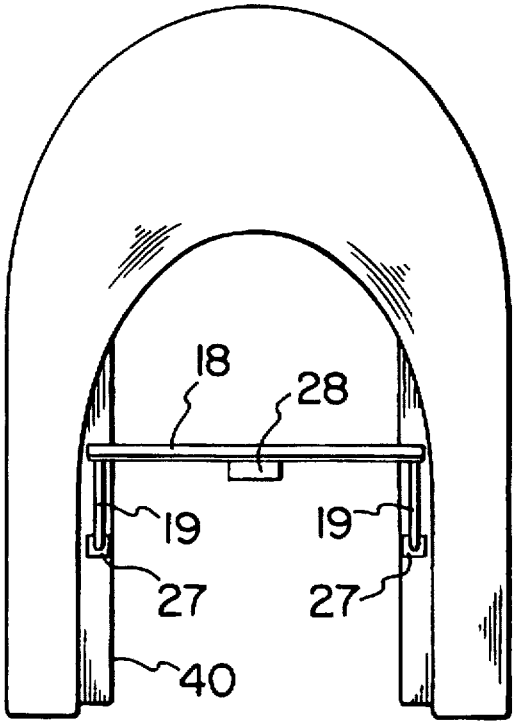
FIG. 5 is a top view showing a first embodiment of a transom board for use with the boat of the invention.
Figure 6:
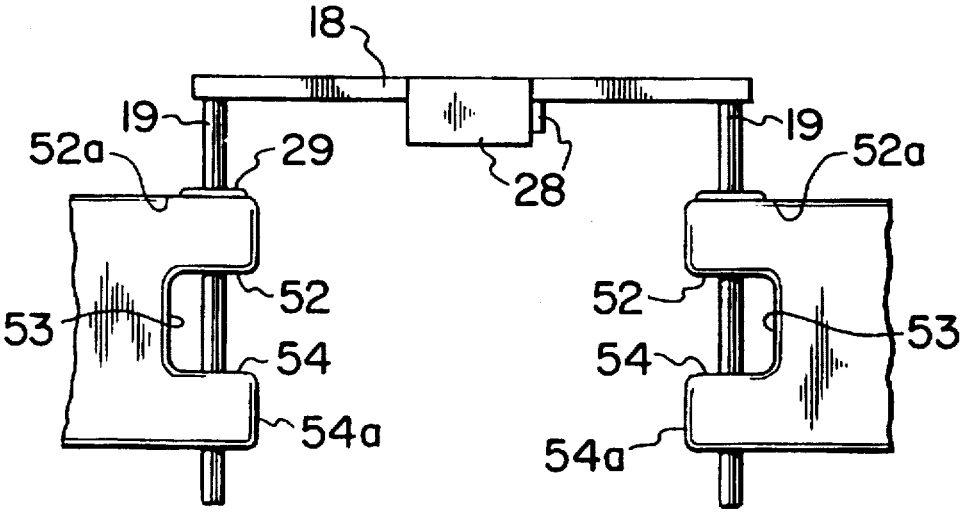
FIG. 6 is a rear view of the transom board of FIG. 5.
Figure 7:
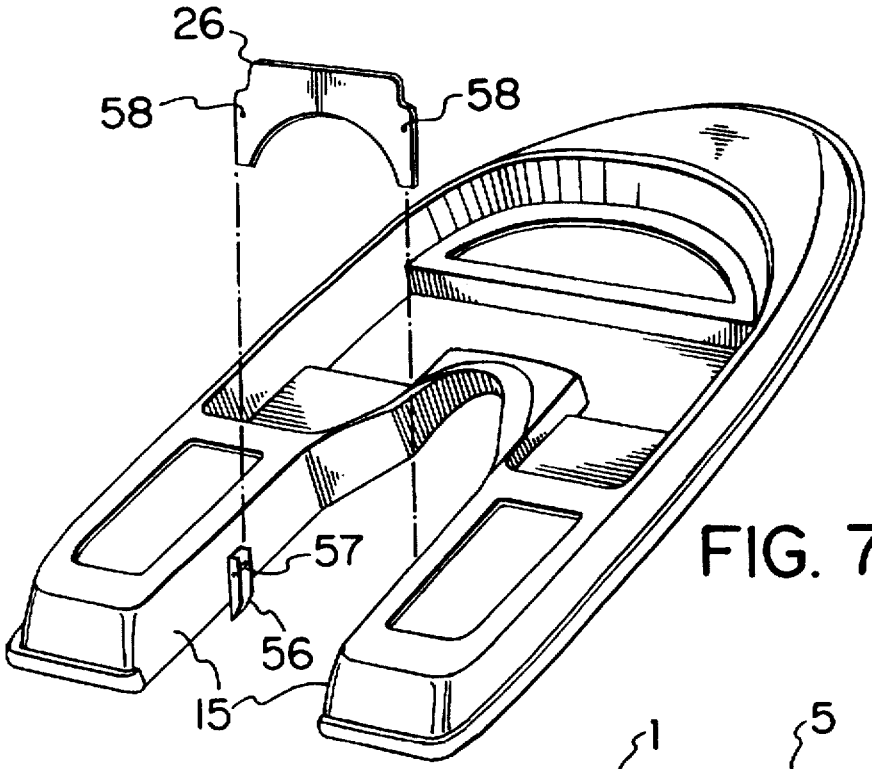
FIG. 7 is a perspective view showing a second embodiment of a transom board for use with the boat of the invention.

Referring to FIGS. 5–7, a conventional outboard motor (not shown) can be mounted on the boat. A first embodiment is shown in FIGS. 5 and 6, in which is shown a square bar 18 spanning the docking bay 51 and functioning as a transom board. The square bar 18 has depending legs 19 formed of steel rods at either end of the square bar 18. The legs 19 are received in slots in the walls 52, 52*a*, 54, 54*a* defining the PWC mounting mechanism 40. Tits 27, such as are used for ski bar supports for ski boats, reinforce the tops of the slots in the walls 52*a*, 54*a*. A washer 29 secured on each leg 19 stops the leg 19 at a designated height suitable for mounting a motor. Plates 28 welded onto each side of the bar 18 at the center of the bar 18 are used to mount a motor.

As shown in FIG. 7, a second embodiment of transom board is shown. In this embodiment, a transom board 26 is mounted in a bracket 56 attached to each wall 15 of the rear hull portions 3*a* and 3*b*. The brackets 56 are secured as by bolts to the hull portions 3*a* and 3*b*, and a pin 57 may be inserted through the bracket and through holes 58 in the board 26 to secure the transom board in the bracket 56.

Figure 8:
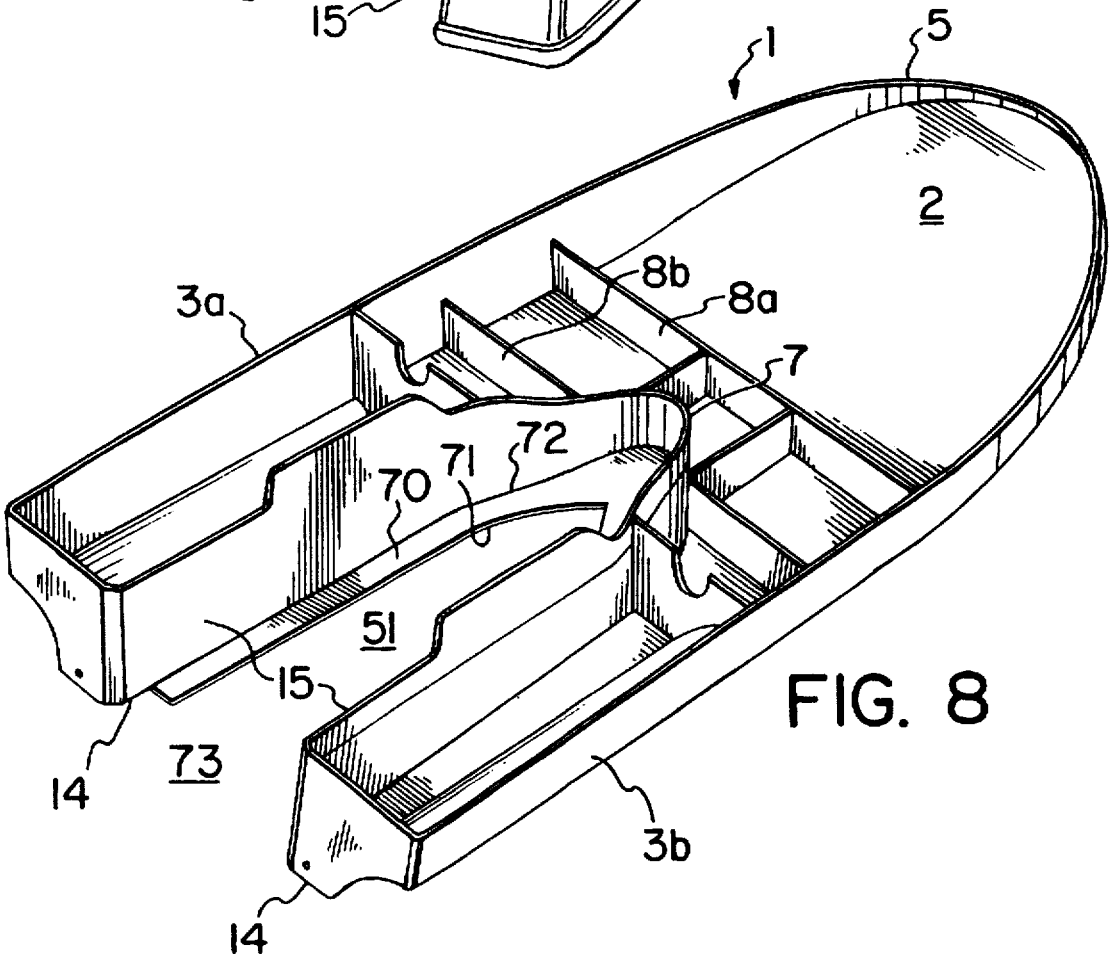
FIG. 8 is a perspective view of a ride plate for use with the boat of the invention.
Figure 9:
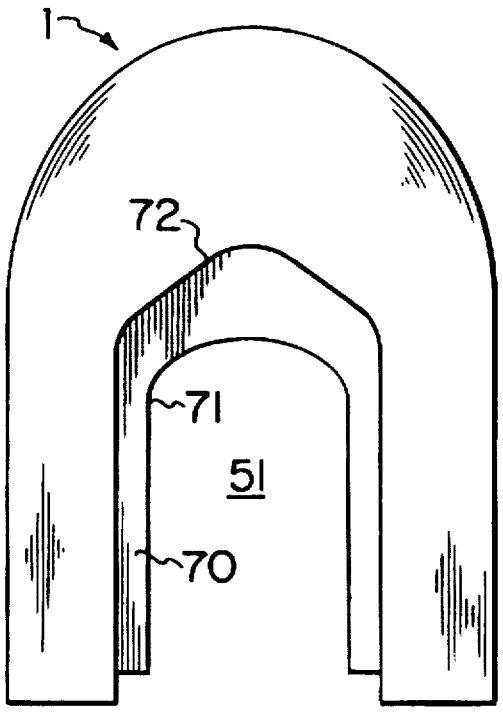
FIG. 9 is a top view of the ride plate of FIG. 8.

Referring to FIGS. 8 and 9, there is shown a ride plate 70 according to an aspect of the invention. The ride plate 70 is fastened, as by bolts, to the bottom 14 (see also FIG. 4B) of the spaced rear hulls 3*a* and 3*b*, preferably extending a considerable portion along the length of the rear hulls 3*a* and 3*b* towards the stern of the boat, at least more than half of the length of the docking bay 51. The ride plate has a concave side 71 and a convex side 72, with the concave side 71 facing rearward towards the open end 73 of the docking bay 51. The ride plate 70 may have constant thickness along the length of the rear hulls 3*a* and 3*b*, but preferably is wider at the forward end of the docking bay 51 near the hull wall 7, thus forming a crescent or boomerang shape. For example, the ride plate may be 5" wide along the rear hull portions 3*a* and 3*b*, and 32" thick at the forward end. Total length of the exemplary ride plate shown is 7½ feet. The limitation on the dimensions of the concave side of the ride plate 70 is that it must be wide enough to accept the lower portion of the hull of a PWC when the PWC is in the docking bay 51. The boomerang shaped ride plate 70 assists in eliminating turbulence in the docking bay, that might slow the boat down, by providing a smooth transition between the hull of the boat and the hull 36 of a personal watercraft.

The following velocity data was recorded during testing of the present invention: Velocity of PWC alone with 1 passenger=39 m/hr. Velocity of PWC and boat with 1 passenger=32 m/hr. Velocity of PWC and boat with 2 passengers=30 m/hr.

A person skilled in the art could make immaterial modifications to the invention described and claimed in this patent without departing from the essence of the invention.

The embodiments of the invention in which an exclusive property or privilege is claimed are defined as follows:

1. A boat for use in combination with a personal watercraft having a bumper on each side of the personal watercraft, the boat comprising:

a hull having a bow and a stern;

the stern of the hull being separated into first and second rear hull portions forming a docking bay between them;

the first rear hull portion including a first side facing the docking bay;

the second rear hull portion including a second side facing the docking bay;

a first longitudinal U-shaped bumper receiving channel fastened to the first side for holding the bumper of a personal watercraft; and a second longitudinal U-shaped bumper receiving channel fastened to the second side for holding the bumper of a personal watercraft, wherein at least one of the first and second U-shaped bumper receiving channels includes a clamping mechanism.

2. The boat of claim 1 wherein the clamping mechanism include an adjustable plate, a locking plate slidably disposed on the adjustable plate and a means for moving the locking plate in relation to the adjustable plate.

3. The boat of claim 1 in which the position of each U-shaped bumper receiving channel is adjustable.

4. The boat of claim 1 in which the U-shaped bumper receiving channels extend along the length of each of the first and second rear hull portions.

* * * * *